United States Patent [19]

Yamamoto et al.

[11] Patent Number: 4,892,073

[45] Date of Patent: Jan. 9, 1990

[54] IGNITION SYSTEM FOR INTERNAL COMBUSTION ENGINES

[75] Inventors: Noboru Yamamoto, Kariya; Masakuni Tsujimura, Anjo; Kiyotaka Sasaki, Nagoya; Kouichi Kato, Kuwana; Hideji Tani, Anjo; Yasuo Ito, Nagoya; Takeshi Matsui, Toyohashi; Kenji Hashimoto, Kariya, all of Japan

[73] Assignee: Nippondenso Co., Ltd., Kariya, Japan

[21] Appl. No.: 241,216

[22] Filed: Sep. 7, 1988

[30] Foreign Application Priority Data

Sep. 10, 1987 [JP] Japan ..... 62-226990

[51] Int. Cl.[4] ..... F02P 5/15

[52] U.S. Cl. ..... 123/417; 123/630; 364/431.04; 364/431.11; 371/16.4; 324/380

[58] Field of Search ..... 123/416, 417, 630, 479; 364/431.04, 431.11; 371/7, 12, 14, 15

[56] References Cited

U.S. PATENT DOCUMENTS

| | | | |
|---|---|---|---|
| 4,099,495 | 7/1978 | Kiencke et al. | 123/480 |
| 4,117,807 | 10/1978 | Barnard | 123/478 |
| 4,267,569 | 5/1981 | Baumann et al. | 123/417 X |
| 4,392,474 | 7/1983 | Minner | 123/644 |
| 4,584,645 | 4/1986 | Kosak | 123/417 X |
| 4,584,978 | 4/1986 | Sasaki et al. | 123/417 |
| 4,597,373 | 7/1986 | Andreasson | 123/417 X |
| 4,644,917 | 2/1987 | Yakuwa et al. | 123/417 X |
| 4,690,122 | 9/1987 | Sasakura et al. | 123/417 X |
| 4,735,187 | 4/1988 | Kato | 123/651 |
| 4,787,354 | 11/1988 | Wilens et al. | 123/417 X |
| 4,797,828 | 1/1989 | Suzuki et al. | 123/479 X |
| 4,805,576 | 2/1989 | Abe et al. | 123/479 |

FOREIGN PATENT DOCUMENTS 61-255275 11/1986 Japan .

*Primary Examiner*—Willis R. Wolfe

*Attorney, Agent, or Firm*—Cushman, Darby & Cushman

[57] ABSTRACT

An ignition system for internal combustion engines comprises means for generating an ignition signal in synchronism with the revolution of an internal combustion engine and an ignition circuit device for interrupting a primary current of an ignition coil in accordance with the ignition signal. The ignition circuit device includes an ignition monitor signal producing circuit for producing an ignition monitor signal which circuit operates to set the ignition monitor signal at the time of starting the energization of the ignition coil and thereafter to reset the ignition monitor signal at a subsequent predetermined timing, whereby the ignition circuit device operates, in accordance with the pulse width and the set and reset conditions of the ignition monitor signal, to decide whether the operation of the ignition circuit device is normal or abnormal, to control to generate a predetermined amount of ignition energy, and to prevent erroneous generation the ignition monitor signal due to a noise or the like.

14 Claims, 11 Drawing Sheets

IGNITION SYSTEM FOR INTERNAL COMBUSTION ENGINES

BACKGROUND OF THE INVENTION

1. FIELD OF THE INVENTION

The present invention relates to an ignition system for internal combustion engines in which the primary current of an ignition coil is interrupted by an ignition circuit means on the basis of an ignition signal supplied from an electronic control unit.

2. DESCRIPTION OF THE RELATED ART

Prior art ignition systems of this type are constructed so that an ignition circuit means generates a monitor signal for monitoring whether the ignition circuit means is operating normally or not on the basis of an ignition signal from an electronic control unit. In particular, there has been proposed a structure in which, in order to monitor a short-circuiting fault of an ignition coil, an ignition monitor signal is set when the primary current of the ignition coil reaches a first reference level after the conduction of the primary current has been started, and the ignition monitor signal is reset when the primary current reaches a second reference level higher than the first reference level. An example thereof is provided by an ignition system for internal combustion engines disclosed by JP-A-61-255275.

However, since, in the above-mentioned conventional ignition system, an ignition monitor signal is set when the primary coil current reaches a first reference level after the primary coil current has started flowing, there is a problem that, if the primary coil current is interrupted at an ignition timing immediately after the primary coil current has reached the first reference level as is the case with an abrupt change in the engine speed (at the time of acceleration or deceleration), the ignition monitor signal is reset immediately, and hence it is not possible to assure a sufficient pulse duration for the ignition monitor signal.

Further, in such a case that a power transistor is turned on for the purpose of circuit protection when a spark plug fails to spark, for example, there is a problem that an ignition monitor signal is generated erroneously in the absence of an ignition signal.

SUMMARY OF THE INVENTION

The object of the present invention is to provide an ignition system which allows a sufficient pulse width of an ignition monitor signal to be assured even when a sudden change of the engine speed occurs, and which prevents an ignition monitor signal from being generated erroneously in the absence of an ignition signal.

According to a first aspect of the present invention, there is provided an ignition system for internal combustion engines comprising an electronic control unit for computing an ignition timing electronically in accordance with parameters of an internal combustion engine, computing an energization time of an ignition coil and producing a pulse-shaped ignition signal in accordance with a result of the computation, and an ignition circuit means for interrupting the primary current of the ignition coil on the basis of the ignition signal supplied from the electronic control unit and producing an ignition monitor signal, wherein the ignition circuit means includes set means for setting the ignition monitor signal at a timing of starting energization of the ignition coil, first reset means for resetting the ignition monitor signal when the primary current of the ignition coil has exceeded a first reference level and has reached a second reference level higher than the first reference level, second reset means for resetting the ignition monitor signal when the primary current of the ignition coil is interrupted before the primary current reaches the second reference level after the primary current has exceeded the first reference level, and maintenance means for maintaining a preceding state without resetting the ignition monitor signal when the primary current does not reach the first reference level.

According to a second aspect of the present invention, there is provided an ignition system for internal combustion engines further comprising current limiting means for limiting the primary current of the ignition coil to a predetermined value when the primary current reaches a third reference level still higher than the second reference level, the predetermined value being determined in accordance with the third reference level.

According to a third aspect of the present invention, there is provided an ignition system for internal combustion engines further comprising a monostable circuit triggered at the reset timing of the ignition monitor signal for generating a monostable signal of a predetermined time width.

According to a fourth aspect of the present invention, there is provided an ignition system for internal combustion engines, in which the ignition circuit means includes an ignition monitor signal producing circuit and fault decision means for deciding that a fault has occurred when a pulse width of the ignition monitor signal produced by the ignition monitor signal producing circuit is smaller than a predetermined value or when the reset of the ignition monitor signal is not detected.

According to a fifth aspect of the present invention, there is provided an ignition system for internal combustion engines in which the fault decision means includes ignition monitor signal width decision means, counting means for counting the number of times of occurrence of abnormal states, and count value decision means for deciding that a fault has occurred when a count value of the counting means exceeds a predetermined level.

According to a sixth aspect of the present invention, there is provided a method of deciding that the operation of an ignition circuit means is normal or faulty, which method is used in an ignition system for internal combustion engines comprising ignition signal generating means and the ignition circuit means including an ignition monitor signal producing circuit.

DESCRIPTION OF THE PREFERRED EMBODIMENTS

Embodiments of the present invention will be explained hereinafter with reference to the accompanying drawings.

Figure 1:
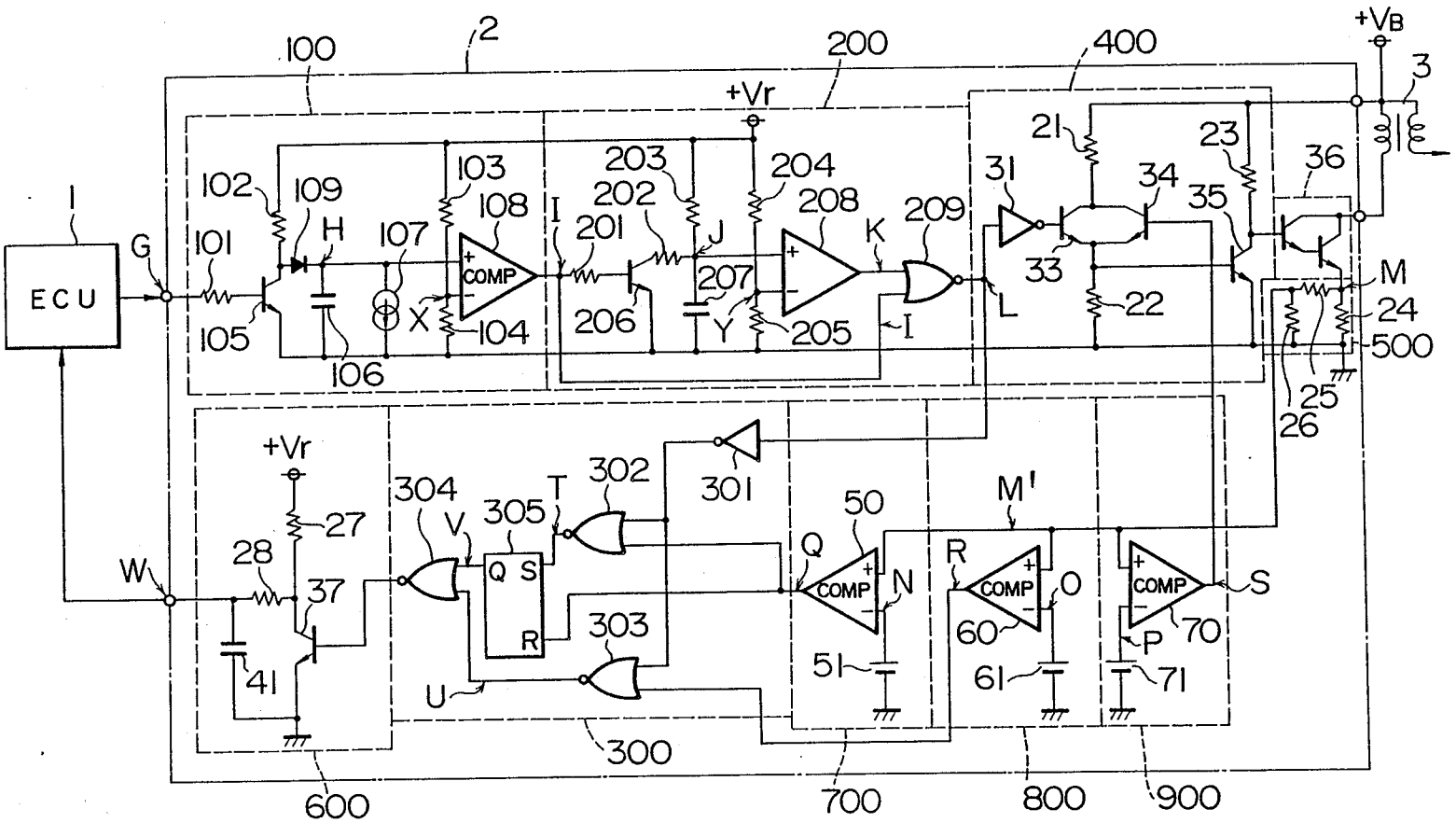
FIG. 1 is a circuit diagram showing an electronic circuit of an ignition system for internal combustion engines according to a first embodiment of the present invention.

FIG. 1 shows a first embodiment of the present invention. Reference numeral 1 designates an electronic control unit (ECU) for computing an ignition timing electronically in accordance with operation parameters of an internal combustion engine, computing an energization time of an ignition coil and producing a pulse-shaped ignition signal. The ECU 1 includes a microcomputer having a function such as computing and controlling an amount of fuel injection in accordance with engine parameters. Numeral 2 designates ignition circuit means for interrupting a primary current of the ignition coil in accordance with an ignition signal generated by the ECU 1 and supplying an ignition monitor signal to the ECU 1. Numeral 3 designates an ignition coil the secondary winding of which is connected to a spark plug (not shown) of each of engine cylinders through a distributor not shown. In the ignition circuit means 2, numeral 100 designates a shaping circuit for shaping the waveform of an ignition signal supplied from the ECU 1, numerals 101 to 104 resistors, numeral 105 a transistor, numeral 107 a constant current source, numeral 108 a comparator, and numeral 109 a diode. Numeral 200 designates an ignition coil energization time limiting circuit for preventing the ignition coil 3 from being energized for a time longer than a predetermined time. Numerals 201 to 205 designate resistors, numeral 206 a transistor, numeral 207 a capacitor, numeral 208 a comparator, and numeral 209 a NOR gate. Numeral 300 designates a logic circuit for producing an ignition monitor signal, numeral 301 an inventor, numerals 302 to 304 NOR gates, and numeral 305 a flip-flop constituting maintenance means. The inverter 301 and he NOR gate 302 constitute set means. Numeral 400 designates a drive circuit, numeral 21 to 23 resistors, numeral 31 an inverter, and numerals 33 to 35 transistors. Numeral 36 designates a power transistor for interrupting the primary current of the ignition coil 3, numeral 500 a resistor circuit for detecting the primary current of the ignition coil 3, and numerals 24 to 26 resistors. Numeral 600 designates an ignition monitor signal producing circuit, numeral 37 a transistor for outputting an ignition monitor signal, numeral 41 a capacitor for the circuit protection, and numeral 27 and 28 resistors. Numeral 700 designates a first comparison circuit, numeral 50 a first comparator for comparing a value of the primary current of the ignition coil 3 with a first reference level, and numeral 51 a reference voltage source for providing the first reference level. Numeral 800 designates a second comparison circuit, numeral 60 a second comparator for comparing a value of the primary current of the ignition coil 3 with a second reference level, and numeral 61 a reference voltage source for providing the second reference level. Numeral 900 designates a current limiting circuit, numeral 70 a third comparator for comparing a value of the primary current of the ignition coil 3 wirh a third reference level, and numeral 71 a reference voltage source for providing the third reference level. The second comparator 60 and the NOR gates 303 and 304 constitute first reset means, and the first comparator 50 constitute second reset means.

Figure 2:
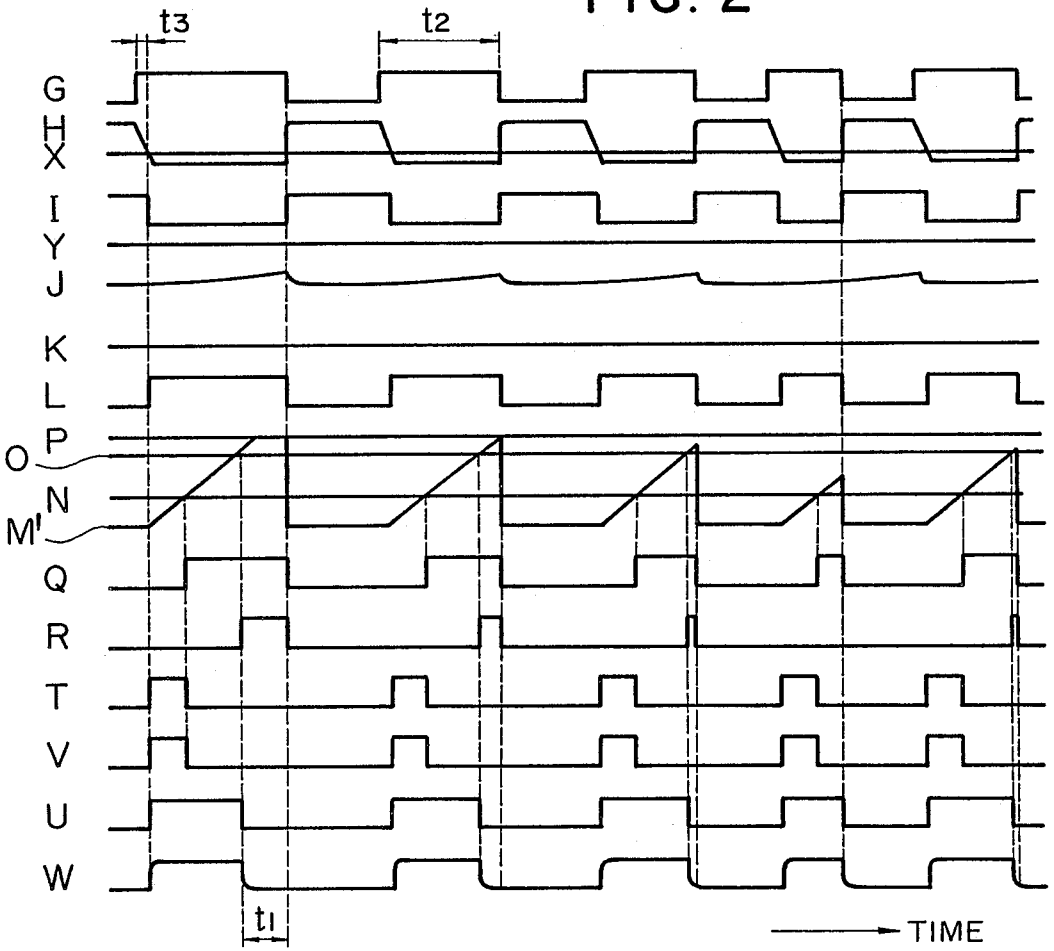
FIGS. 2 to 6 are waveform diagrams showing waveforms appearing at various parts of the ignition system shown in FIG. 1 for explaining the operation of the ignition system.

The operation of the electronics circuit having the aforementioned construction will be explained hereunder. FIG. 2 shows waveforms appearing at various parts of the electronic circuit. The transistor 105 is turned on and off by an ignition signal (shown by G in FIG. 2) supplied from the ECU 1. When the transistor 105 in turned off, the capacitor 106 is charged through the resistor 102 and the diode 109. When the transistor 105 is turned on, on the other hand, the charge stored in the capacitor 106 is released in the form of a constant current flowing through the constant current source 107. The terminal voltage (shown by H in FIG. 2) of the capacitor 106 is compared with a given voltage (shown by X in FIG. 2) determined by the resistors 103 and 104 in the comparator 108. The output of the comparator 108 takes the waveform I shown in FIG. 2 which is delayed from the ignition signal G by a time t3 as shown in FIG. 2. In other words, the haping circuit 100 provides the delay time t3. By virtue of providing this delay time t3, the shaping circuit 100 functions to remove a noise. The time t3 is usually set to about several tens μsec to several hundreds μsec to effect noise elimination. In response to an output of the comparator 108, the transistor 206 is turned on and off. When the transistor 206 is turned off, the capacitor 207 is charged through the resistor 203, while, when the transistor 206 is turned on, the capacitor 207 discharges rapidly through the resistor 202. The voltage (shown by J in FIG. 2) across the capacitor 207 is compared with a given voltage (shown by Y in FIG. 2) determined by the resistors 204 and 205 in the comparator 208 which produces an output waveform K shown in FIG. 2. Thus, when the time t2 shown in FIG. 2 exceeds a predetermined time width, the terminal voltage J of the capacitor 207 reaches the reference level Y, and the output K of the comparator 208 is reversed. The output K of the comparator 208 and the output I of the comparator 108 are applied to the NOR gate 209, and the NOR gate 209 outputs a signal (shown by L in FIG. 2) as an output signal from the energization time limiting circuit 200. This signal L is used to interrupt the power transistor pair 36 through the transistors 33 and 35. When the power transistor pair 36 is turned on, the primary current of the ignition coil 3 flows through the current detection resistor 24 via the power transistor 36. The resistor 24 detects the primary current of the ignition coil 3. Then, a divided voltage M' of the detected voltage M shown in FIG. 2 generated across the resistor 24 is compared with the first reference level (shown by N in FIG. 2), which is provided by the reference voltage source 51, in the first comparator 50, and the first comparator 50 produces an output signal Q shown in FIG. 2. Further, the divided voltage M' is compared with a second reference level (shown by O in FIG. 2), which is provided by the reference voltage source 61, in the second comparator 60, and the second comparator 60 produces an output signal R shown in FIG. 2. Furthermore, when the divided voltage M' reaches a third reference level (shown by P in FIG. 2) provided by the reference voltage source 71, the operation of the transistor 34 is controlled by an output S of the third comparator 70. Then, the operation of the transistor 35 is controlled by the operation of the transistor 34, thereby controlling an input base current flowing into the power transistor pair 36 and thus limiting the primary current of the ignition coil 3 to a given value which is determined by the third reference level P. The logic circuit 300 inputs a reversed signal of the output signal L of the energization time limiting circuit 200, an output signal Q of the first comparator 50 and an output signal R of the second comparator 60, generates therewithin waveforms T, V and U shown in FIG. 2, and finally produces an ignition monitor signal (shown by W in FIG. 2) at an output terminal of the ignition monitor signal producing circuit 600.

The provision of the first reference level N is to serve the purpose of deciding whether the ignition is effected normally. When the first reference level N is converted in terms of the primary current value of the ignition coil 3, it amounts to a current value (2 A) which is about one third of an interruption current value (6 A) of the primary current under a normal engine operation. The provision of the second reference level O, on the other hand, is to serve the purpose of providing an ignition coil energization data to be fed back to the ECU 1 as a data necessary for the ECU 1 to compute and determine an energization time of the ignition coil 3. This second reference level O is set to a level of about 5 A or about three times as high as the first reference level N.

The third reference level P is provided to limit the primary current of the ignition coil 3 to a given level in order to prevent breakage of the power transistor 6 due to an overcurrent. It is set to a level of 6 A which is higher than the second reference level O by about 1 A when converted in terms of the primary current value.

In the above-described construction, an ignition monitor signal W is set by the logic circuit 300 substantially in synchronism with the start timing of the ignition signal from the ECU 1, and is reset when the primary current of the ignition coil 3 exceeds the first reference level N and reaches the second reference level O. While, when the primary current is interrupted before it reaches the second reference level O after it has exceeded the first reference level N, the ignition monitor signal W is reset at the timing of the interruption of the primary current. Further, when the primary current does not reach the first reference level N, the ignition monitor signal W is not reset but it maintains a preceding state thereof.

Under a normal operating condition, the ignition monitor signal W has a pulse width covering the range from the conduction start timing of the primary current of the ignition coil 3 to the timing when the primary current reaches the second reference level O, which is usually a pulse width of about 3 ms. This pulse width of the ignition monitor signal W is sufficiently great as compared with a time width (several us to several tens us) of noises superimposed on the ignition monitor signal W from the wire harnesses, etc. The ignition monitor signal W can be safely led into an internal circuit of the ECU 1 after the noises have been removed therefrom through a filter circuit (not shown) arranged in an ignition monitor signal input circuit of the ECU 1.

On the basis of the ignition monitor signal W and the ignition signal G, the ECU 1 measures the time tl shown in FIG. 2 and computes and determines the ignition coil energization start timing and the energization time length (shown by t2 in FIG. 2) of the ignition coil 3 so that the time tl has a predetermined time length. By controlling the time tl in FIG. 2 to have a fixed time width of several hundreds μs, an interrupted primary current of the ignition coil 3 is controlled to take a substantially constant current value higher than the second reference level O but lower than the third reference level P shown in FIG. 2 in the normal operation range. Thus, in the normal operation range, it does not occur to limit the primary current to the third reference level P by means of the power transistor pair 36, and therefore power consumption of the power transistor pair 36 is confined within a small amount, thereby making it possible to minimize heat dissipation occurring in the power transistor pair 36. The time tl shown in FIG. 2 may alternatively be controlled to take a predetermined value correlated with the engine speed or the power source voltage (battery voltage).

Figure 3:
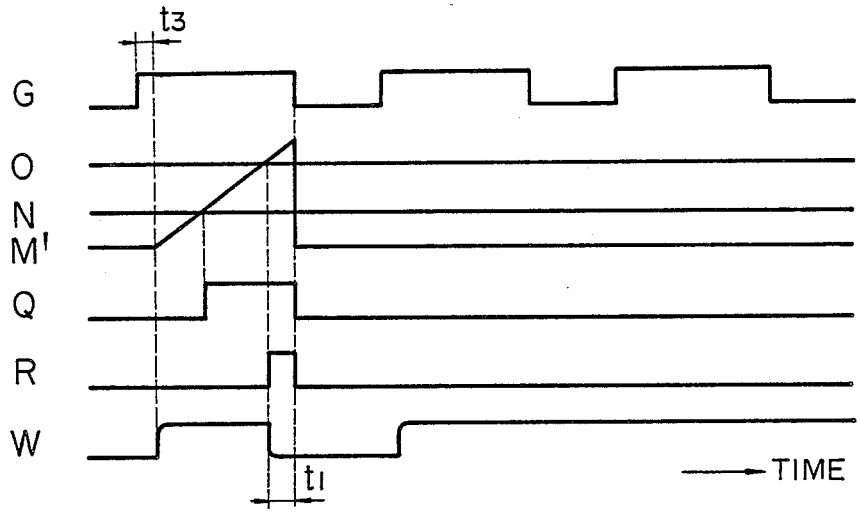
Figure 4:
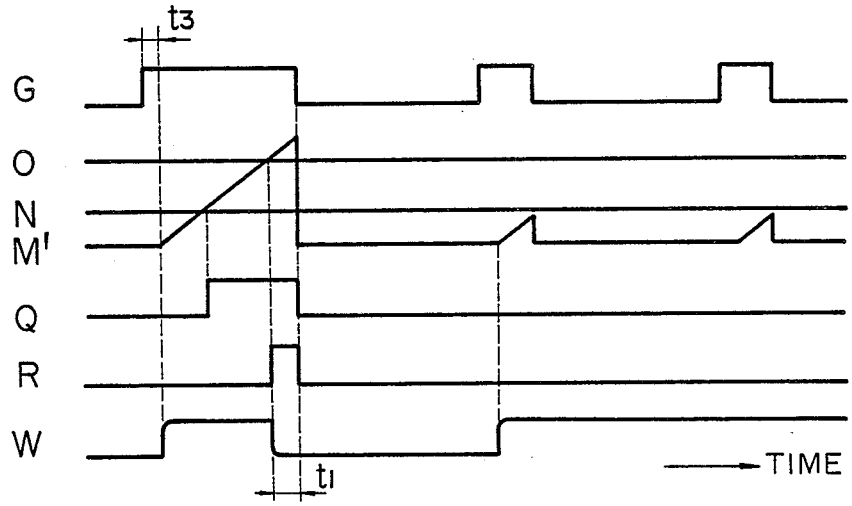
Figure 5:
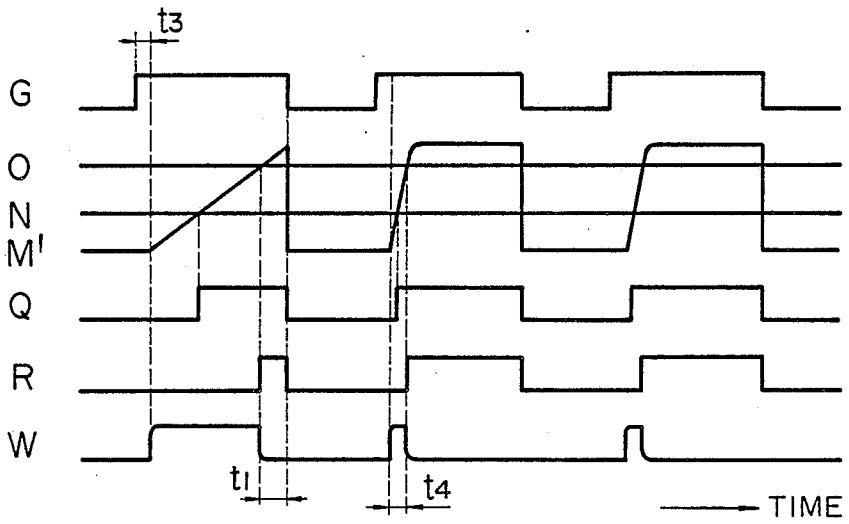
Figure 6:
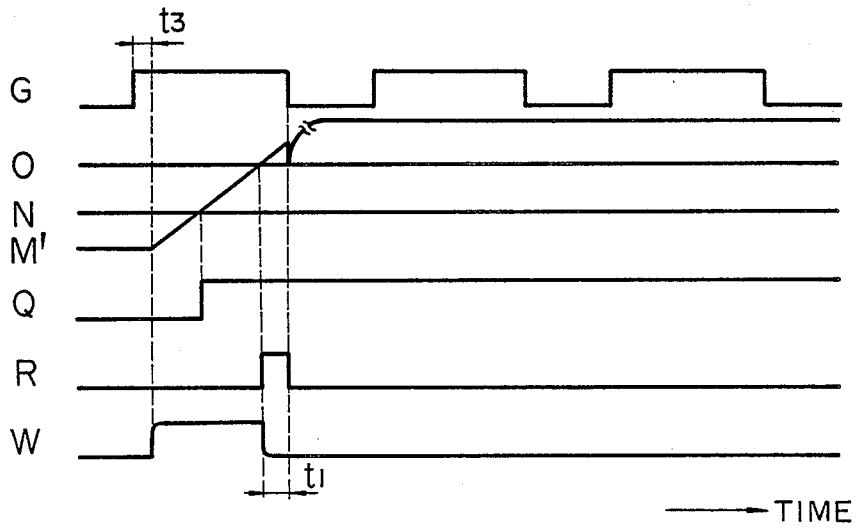

Further, the ECU 1 monitors a falling edge of the ignition monitor signal W shown in FIG. 2 at every ignition cycle, and decides that the ignition circuit means 2 is normal, if the presence of a falling edge of the ignition monitor signal is detected. However, if the present of a falling edge of the ignition monitor signal W within a predetermined time from the ignition coil energization start timing is detected, the ECU 1 decides that the ignition circuit means 2 is faulty. The ECU 1 decides also that the ignition circuit means 2 is faulty, if it is not possible to detect the presence of a falling edge of the ignition monitor signal W in each ignition cycle. Upon deciding that the ignition circuit means 2 is faulty by using the ignition monitor signal in the above-described method, the ECU 1 stops fuel supply. In this way, it is made possible to prevent a raw mixture gas from being supplied to an exhaust gas purifying catalyst, thereby preventing the catalyst from being fused by overheating FIGS. 3 to 6 show waveforms appearing at various parts when the ignition performance has become faulty. FIG. 3 shows a case where the collector-emitter circuit of the power transistor pair 36 has become opened or the primary side of the ignition coil 3 has become opened (disconnected). FIG. 4 shows a case where the pulse width of the ignition signal G from the ECU 1 is abnormal. FIG. 5 shows a case where a layer-short failure has occurred in the primary or secondary winding of the ignition coil or the leakage of the secondary high voltage of the ignition coil 3 has occurred. FIG. 6 shows a case where a shortcircuit failure has occurred between the collector and emitter of the power transistor pair 36.

Thus, as is seen from the abnormal operation modes shown in FIGS. 3, 4 and 6, no falling edge is contained in the waveform of the ignition monitor signal W when the ignition performance has become faulty. On the other hand, in the abnormal operation mode of FIG. 5, the pulse width of the ignition monitor signal W is indicated by t4, which pulse width t4 becomes shorter than the pulse width under a normal condition.

As consequence, it will be seen from FIGS. 3, 4 and 6 that it is possible to decide whether the ignition performance is faulty or not by monitoring the presence or absence of a falling edge of the ignition monitor signal W in each ignition cycle. While, in the case of the abnormal operation mode of FIG. 5, it is seen that it is possible to decide whether the ignition performance is faulty or not by measuring the time length t4 from the ignition coil energization start timing to the time point where a falling edge of the ignition monitor signal W occurs.

As described above, the occurrence of abnormal ignition performance can be detected accurately.

Figure 7:
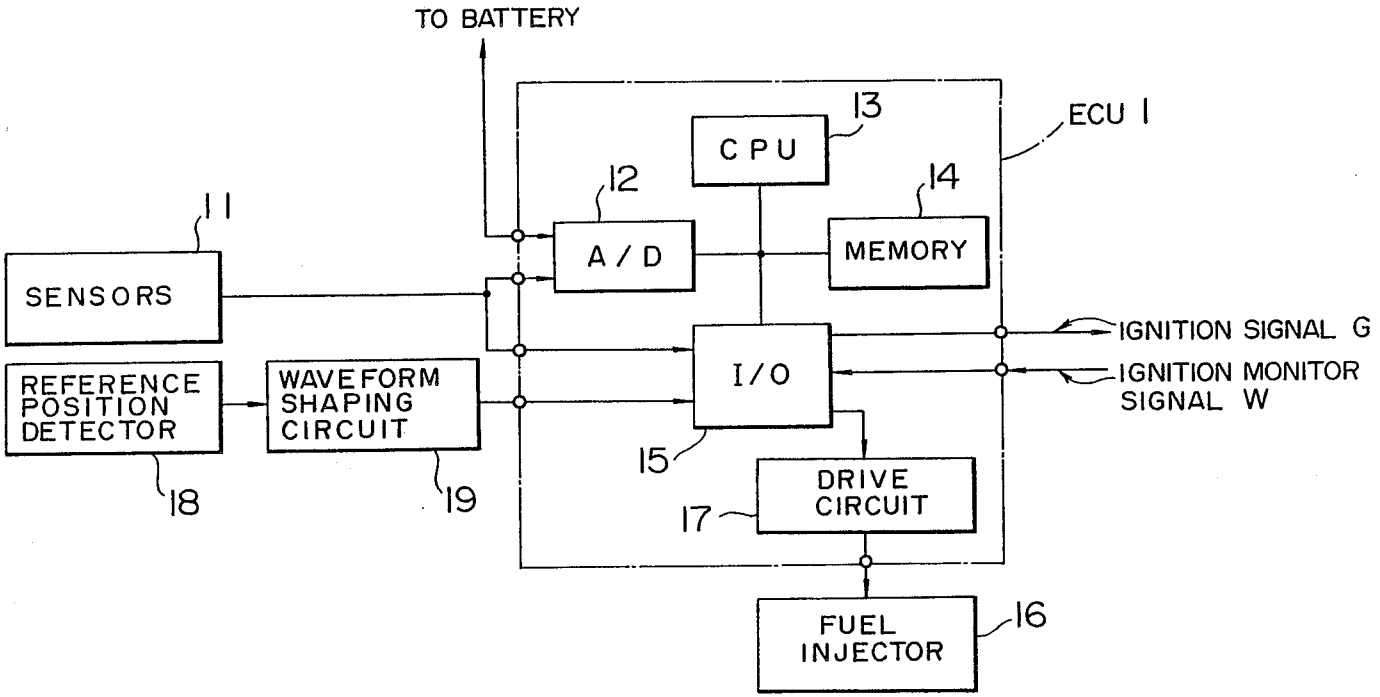
FIG. 7 is a schematic structural diagram showing a general construction of the ECU in the ignition system shown in FIG. 1.
Figure 8:
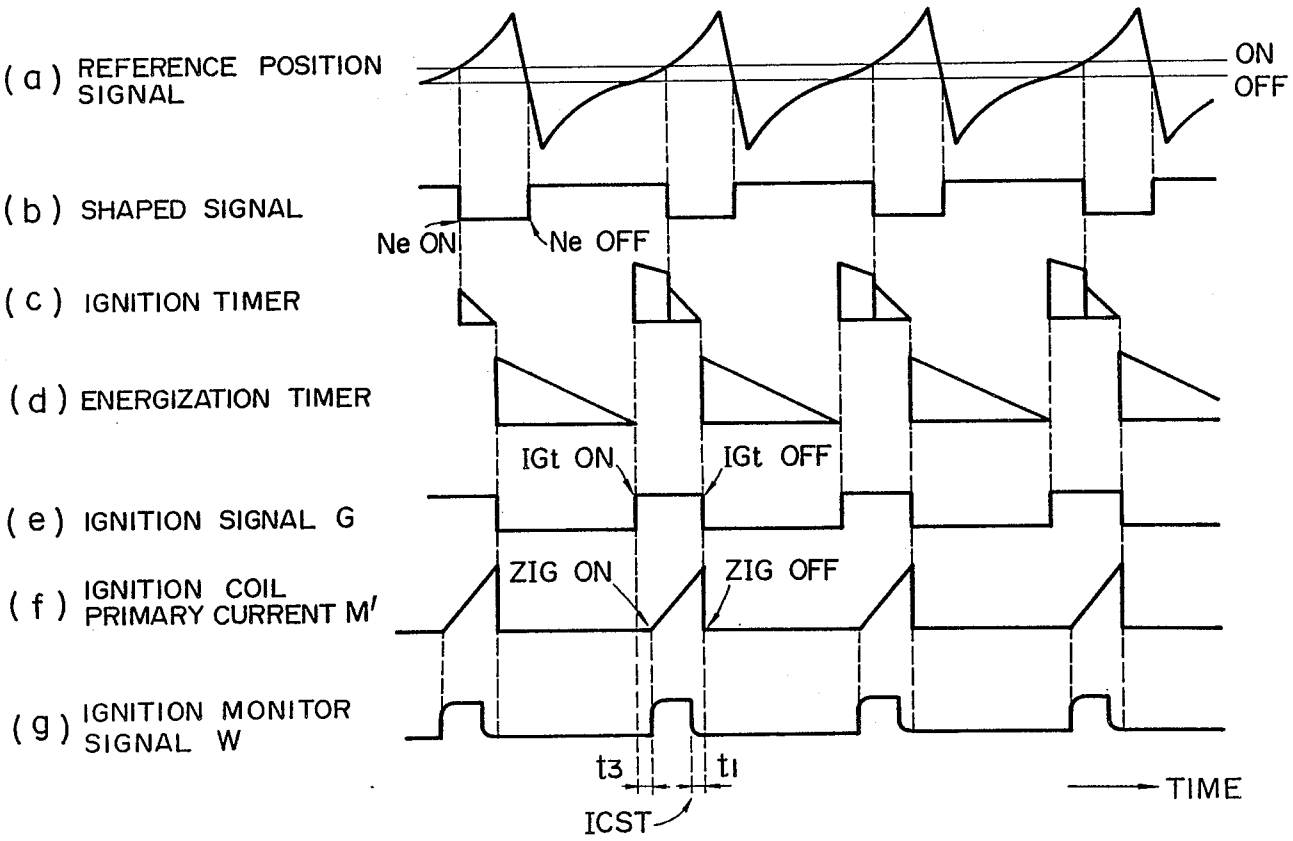
FIGS. 8*a–g* waveform diagrams showing waveforms appearing at various parts of the ECU shown in FIG. 7 for explaining the operation of the ECU.

Now, the schematic construction of the CPU 1 will be explained by making reference to FIG. 7. The ECU 1 is composed of an A/D converter 12 for converting analog signals from various sensors 11 and a battery (not shown) to digital signals, a central processing unit (CPU) 13, a memory 14 for storing a processing program and processing data necessary for the computation by the CPU 13, an input/output circuit (I/O) 15 for inputting and outputting various signals to and from the CPU 13, and a drive circuit 17 for driving a fuel injector 16 by an output signal from the I/O 15. Further, the I/O 15 inputs digital signals from the various sensors 11, a rectangular output signal from a waveform shaping circuit 19 for shaping an output signal shown at FIG. 8(a) of a reference position detector 18 for detecting a reference rotational angular position for each cylinder of an internal combustion engine into a rectangular wave signal shown at FIG. 8(*b*), and an ignition monitor signal W shown at FIG. 8(*g*) supplied from the ignition circuit means 2. Further, the I/O 15 outputs to the ignition circuit means 2 the ignition signal G shown at FIG. 8(*e*) which has been derived from the result of computation by the CPU 13. FIGS. 8(*c*) and (*d*) show an ignition timer waveform and an energization timer waveform, respectively, derived from the computation by the CPU 13, and FIG. 8(*f*) shows a waveform M' of the primary current of the ignition coil.

Figure 9:
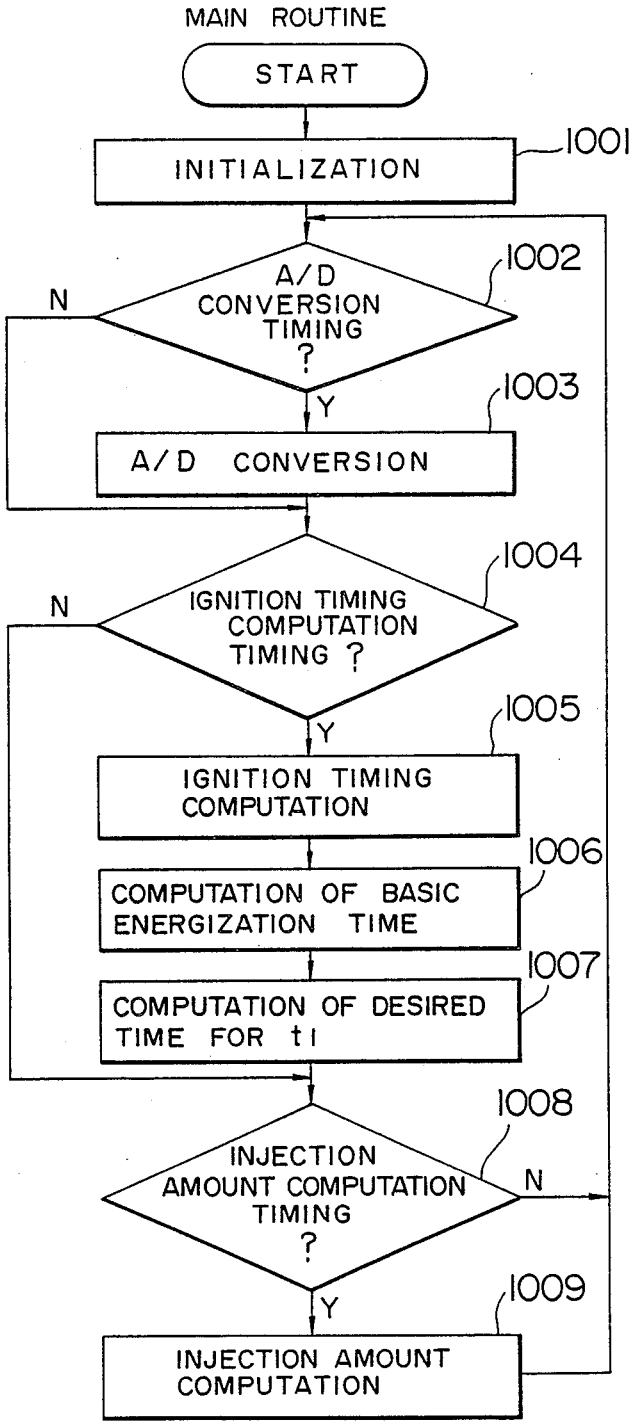
FIGS. 9 to 14 are flowcharts for explaining the operation of the ECU shown in FIG. 7.

An explanation will be made of the operation of the CPU 1 with reference to the flowcharts of FIGS. 9 to 14. FIG. 9 shows a main routine executed at given regular intervals after a key switch (not shown) has been turned on. When the key switch is turned on, step 1001 initializes various constants or the like, and the processing proceeds to step 1002. Step 1002 decides whether a timing of converting various analog signals into digital signals is the case or not. If step 1002 has decided that a conversion timing is the case, the processing proceeds to step 1003, where the A/D conversion is executed, and then the processing proceeds to step 1004. If step 1002 has decided that a conversion timing is not the case, the processing proceeds to step 1004 without executing the A/D conversion. This step 1004 decides whether a timing for computing an ignition timing is the case or not, and if step 1004 has decided that such a timing is the case, the processing proceeds to steps 1005 to 1007, where the computation of an ignition timing, a basic energization time and a desired time for the time tl is effected in accordance with various detected data. Then, the processing proceeds to step 1008. If step 1004 has decided that a timing for computing an ignition timing is not the case, on the other hand, the processing proceeds to step 1008 without executing the computation of an ignition timing or the like. Step 1008 decides whether a timing for computing a fuel injection amount is the case or not, and if it is decided that a timing for computing a fuel injection amount is the case, the processing proceeds to step 1009, where the computation of the fuel injection amount is effected in accordance with various detected data, after which the processing returns to step 1002 to repeat the above-mentioned steps.

Figure 10:
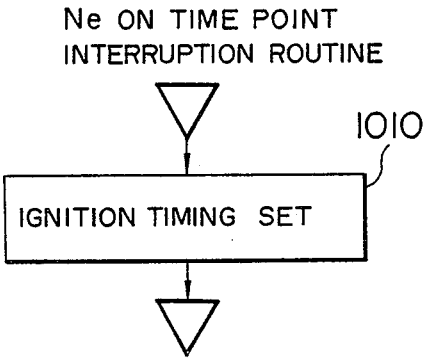

FIG. 10 shows an Ne ON time point interrupting routine executed each time the level of the shaped signal shown at FIG. 8(*b*) changes from high to low (Ne ON time point). At each Ne ON time point, the processing proceeds to step 1010, as shown in FIG. 10, where an ignition timing is set in the ignition timer in place of the energization time limiting timing, as shown in FIG. 8(*c*).

Figure 11:
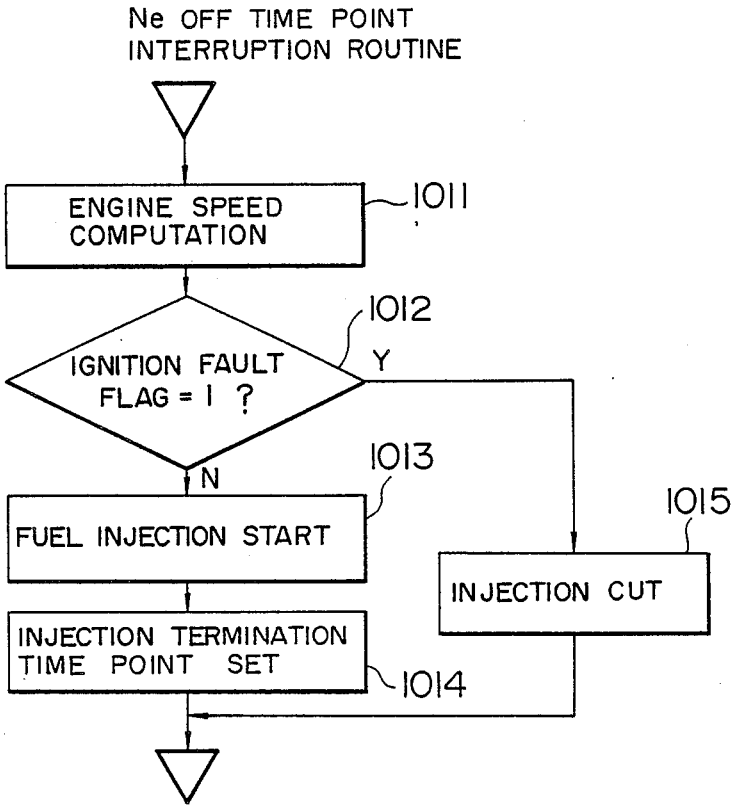

FIG. 11 shows an Ne OFF time point interruption routine executed each time the level of the shaped signal shown at FIG. 8(*b*) changes from low to high (Ne OFF time point). At each Ne OFF time point, the processing proceeds to step 1011, where the computation of an engine speed is effected in accordance with the time intervals of the interruptions, and after then the processing proceeds to step 1012. Step 1012 decides whether the ignition fault flag is "1" or not. If the ignition fault flag is not "1", the processing proceeds to step 1013, where fuel injection is started on the basis of the fuel injection amount computed at step 1009 shown in FIG. 9. After then, the processing proceeds to step 1014, where a fuel injection termination time point is set in a timer. If step 1012 decides that the ignition fault flag is "1", on the other hand, the processing proceeds to step 1015, where fuel injection is cut or cancelled (without starting fuel injection), thereby ending the processing of this routine.

Figure 12:
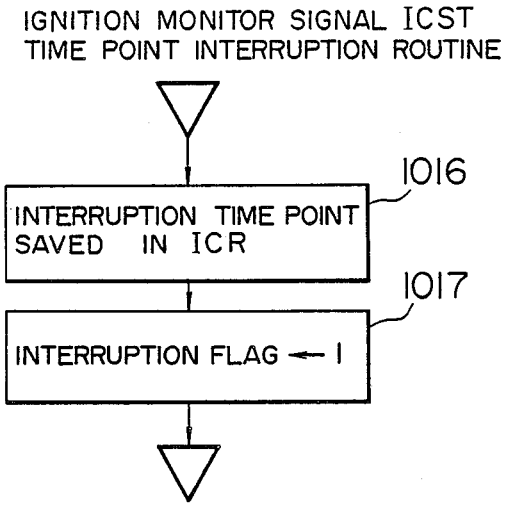

FIG. 12 shows an ignition monitor signal interruption routine which is executed each time the level of the ignition monitor signal W shown at FIG. 8(*g*) changes from high to low (ICST time point). Each time the ignition monitor signal W reaches an ICST time point, the processing proceeds to step 1016, where the interruption time point is stored in an input capture register (ICR). After then, the processing proceeds to step 1017, where the interruption flag for the ignition monitor signal is set to "1".

Figure 13:
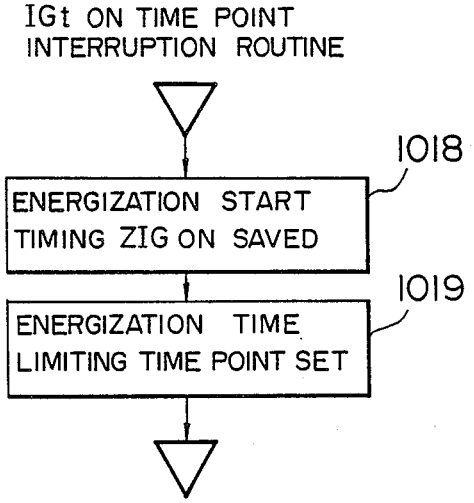

FIG. 13 shows an IGt ON time point interruption routine which is executed each time the level of the ignition signal shown at FIG. 8(e) changes from low to high (IGt ON time point). At each IGt ON time point, the processing proceeds to step 1018, where an ignition coil energization start timing (ZIG ON) is stored in a register. After then, the processing proceeds to step 1019, where an ignition coil energization time limiting time point is set in the ignition timer as shown at FIG. 8(*c*).

Figure 14:
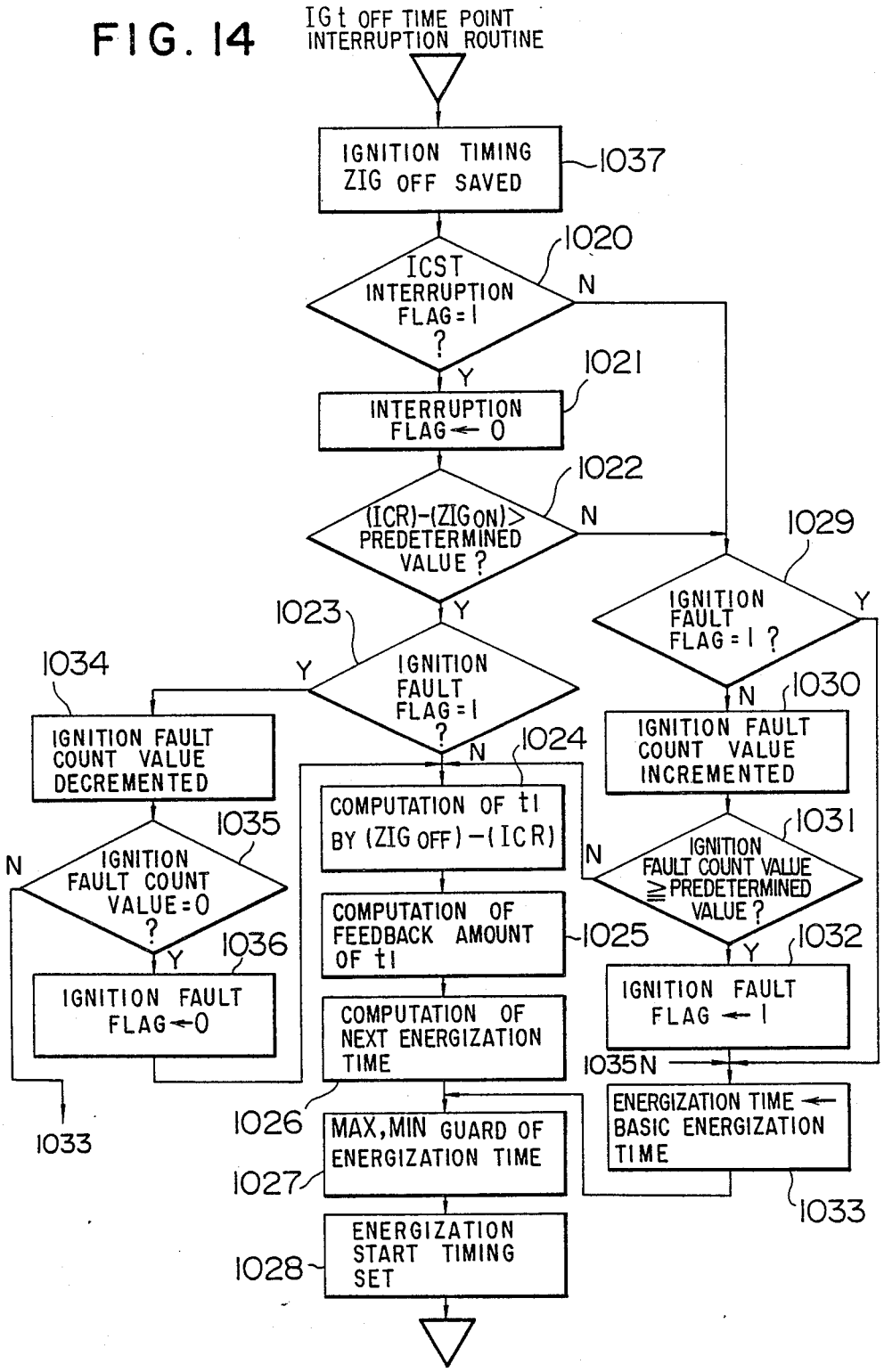

FIG. 14 shows an IGt OFF time point interruption routine executed each time the ignition signal G shown at FIG. 8(*e*) changes from high to low (IGt OFF time point). At each IGt OFF time point, the processing proceeds to step 1037, where an ignition timing (ZIG OFF) is stored in a register. After then, the processing proceeds to step 1020 which decides whether the ICST interruption flag described with reference to FIG. 12 is "1" or not. If it is decided that the ICST interruption flag is "1", the processing proceeds to step 1021, where the interrupting flag is reset to "0". Then, the processing proceeds to step 1022 which decides whether the time width of the ignition monitor signal W, which is equal to the time length (ICST) - (ZIG ON), is greater than a predetermined value or not. If it is decided that the time length (ICST) - (ZIG ON) is greater than a predetermined value, the processing proceeds to step 1023 which decides whether the ignition fault flag is "1" or not. If it is decided that the ignition fault flag is nor "1", the processing proceeds to step 1024 which computes the time tl by the equation t1 =(ZIG OFF) −(ICST). After then the processing proceeds to step 1025, where an amount of feedback to be given by the time t1, that is, a correction amount for a next ignition coil energization time based on a computed value of the time t1, is computed by using the time t1 obtained in step 1024. The processing further proceeds to step 1026, where a next ignition coil energization time is computed by using the feedback amount obtained in step 1025 and other detection data. Then, the processing proceeds to step 1027, where the value of the next ignition coil energization time obtained at step 1026 is adjusted to fall between a maximum value and a minimum value which have been preset beforehand. Then, the processing proceeds to step 1028, where an ignition coil energization start timing is set in an energization timer as shown at FIG. 8(*d*).

On the other hand, if the step 1020 decides that the ICST interruption flag is not "1", or step 1022 decides that the time length (ICST) - (ZIG ON) is not greater than the predetermined value, the processing proceeds to step 1029, which decides whether the ignition fault flag is "1" or nor. If it is decided that the ignition fault flag is "1", the processing proceeds to step 1033, while if it is decided that the ignition fault flag is not "1", the processing proceeds to step 1030, where the count value of the ignition fault counter is incremented by one. After then, the processing proceeds to step 1031. The step 1031 decides whether the count of the ignition fault counter is more than a predetermined value, and if it is decided that the count is not more than a predetermined value, the processing proceeds to step 1024, while if it is decided that the count is more than the predetermined value, the processing proceeds to step 1032, where the ignition fault flag is set to "1". Then, the processing proceeds to step 1033 which sets the ignition coil energization time to a preset basic ignition coil energization time. Thereafter, the processing proceeds to step 1027.

Further, if step 1023 decides that the ignition fault flag is "1", the processing proceeds to step 1034, where the count value of the ignition fault counter is decremented by one. Then, the processing proceeds to step 1035 which decides whether the count value of the ignition fault counter is "0" or not. If the count value is "0", the processing proceeds to step 1036 which resets the ignition fault flag to "0", after which the processing proceeds to step 1024. While, if step 1035 decides that the count value of the ignition fault counter is not "0", the processing proceeds to step 1033.

Figure 15:
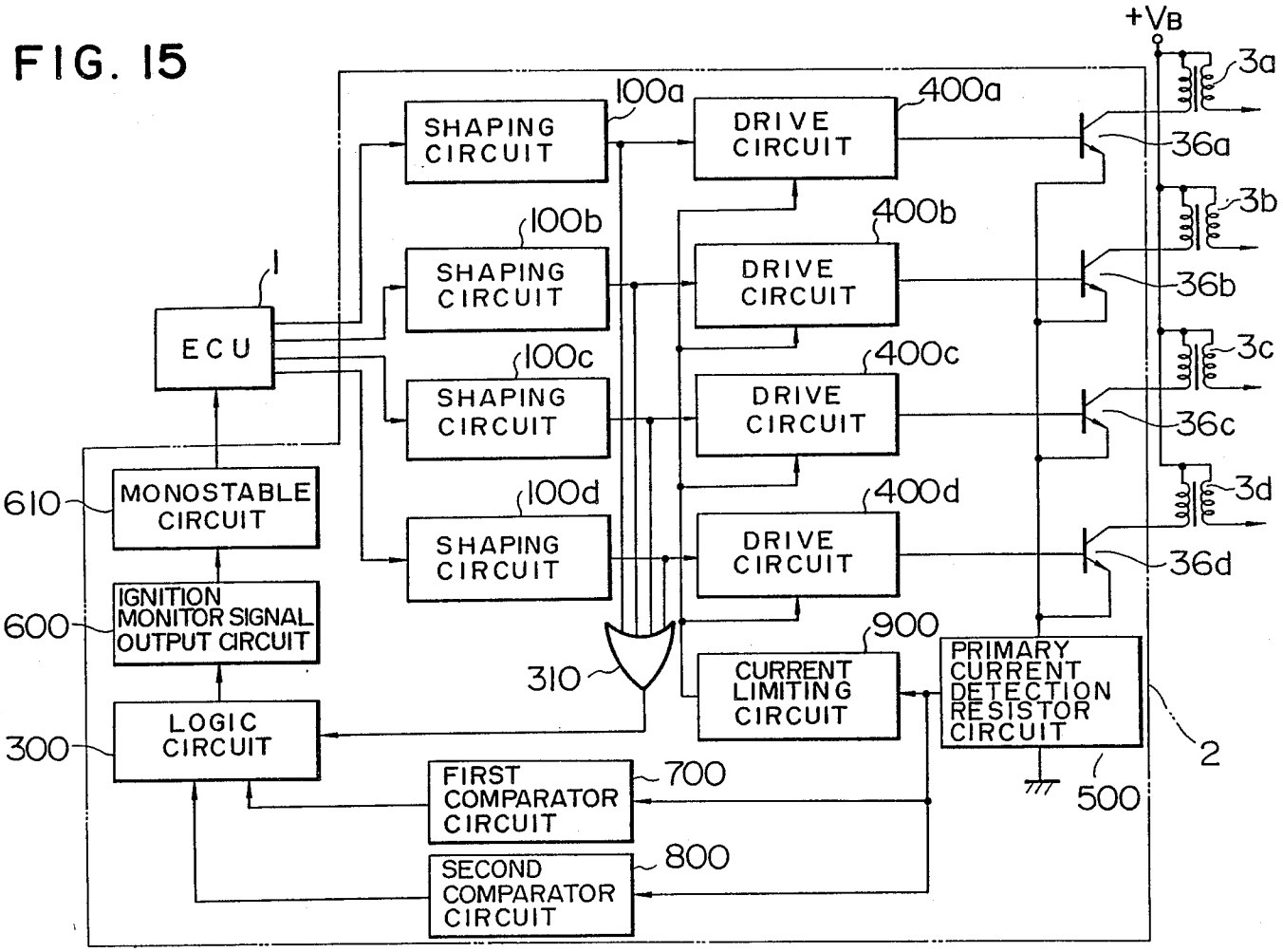
FIG. 15 is a block diagram showing an ignition system for internal combustion engines according to a second embodiment of the present invention.

FIG. 15 shows a second embodiment of the present invention. This second embodiment contemplates to apply the construction of the first embodiment to an internal combustion engine having a multiplicity of engine cylinders. In this second embodiment, the ECU 1 outputs as many ignition signals as the cylinder number through respective separate routes. Namely, these ignition signals are used to drive respective power transistors 36*a* to 36*d* through respective shaping circuits 100*a* to 100*d* and respective drive circuits 400*a* to 400*d* thereby to turn on and off the primary currents of the ignition coils 3*a* to 3*d*, respectively, thus supplying an ignition high voltage to ignition plugs (not shown) of respective engine cylinders which are connected to the secondary windings of the ignition coils 3*a* to 3*d*, respectively. In this second embodiment, the emitters of the power transistors 36*a* to 36*d* are connected commonly to a single primary current detection resistor circuit 500. The outputs of the shaping circuits 100*a* to 100*d* are supplied via an OR gate 310 to a logic circuit 300, and the output of an ignition monitor signal output circuit 600 is connected to a monostable circuit 610 which generates monostable output signals having a predetermined time width in synchronism with a falling change of ignition monitor signals generated by the ignition monitor signal output circuit 600 which falls from a high level to a low level. The monostable output signals are supplied to the ECU 1 in place of the ignition monitor signals. The ECU 1 monitors the monostable output signals. If the time width from the ignition coil energization start timing to the timing of generation of a monostable output signal is shorter than a predetermined value, or if a monostable output signal is not generated in spite that an ignition signal has been generated, the ECU 1 decides that the ignition of an associated engine cylinder is not effected normally. As a result, only the fuel injection into an engine cylinder associated with a power transistor, whose operation has become abnormal, is cut off, while the other normally operating engine cylinders can serve to make the internal combustion engine continue its operation, thus making a fallback made operation of an automobile possible even in such an abnormal state of operation.

Further, as described above with reference to each of the embodiments of this invention, if an optimum ignition coil energization time is computed by the ECU 1 by utilizing the ignition monitor signalsso that the time difference between the ignition timing of an ignition signal and the reset timing of an ignition monitor signal becomes a predetermined time length, thereby determining the pulse width of the ignition signal which is the ignition coil energization time, then, it is possible to reduce the number of interconnection signal lines between the ignition circuit means 2 and the ECU 1.

It will thus be understood from the foregoing description that, according to the present invention, the ignition monitor signal is set at the ignition coil energization start timing. Therefore, even if an ignition timing is reached immediately after the primary current has reached the first reference level such as in the case of occurrence of a sudden change in the engine speed (for instance, at the time of acceleration or deceleration), not only the pulse width of the ignition monitor signal can be guaranteed at least by the time length from the ignition coil energization start timing to the time point when the primary current reaches the first reference level, but also the ignition monitor signal is not set as long as the ignition coil energization start timing is not reached, even if the detection signal indicating a magnitude of the primary current of the ignition coil exceeds the first reference level due to the occurrence of noices or the like while the ignition signal has not been generated, thereby having an excellent advantage of preventing an ignition monitor signal from being generated erroneously.

Further, if the primary current reaches the third reference level higher than the second reference level for resetting the ignition monitor signal, the primary current of the ignition coil is limited to a predetermined value, so that the primary current interruption value at the ignition timing is prevented from becoming excessive by being caused to remain within the limit of a predetermined value, thereby making it possible to obtain ignition energy of a desired appropriate level.

Furthermore, since the monostable circuit is provided to be triggered at the reset timing of the ignition monitor signal so as to generate a monostable output signal having a predetermined time width, by monitoring the state of generation of the monostable output signal, it becomes possible to make an accurate decision as to the ignition circuit means associated with which engine cylinder has become faulty.

What is claimed:

1. An ignition system for internal combustion engines comprising an electronic control unit for computing an ignition timing electronically in accordance with parameters of an internal combustion engine, computing an energization time of an ignition coil and producing a pulse-shaped ignition signal in accordance with a result of the computation, and ignition circuit means for interrupting a primary current of the ignition coil on the basis of the ignition signal supplied from said electronic control unit and producing an ignition monitor signal, wherein said ignition circuit means includes set means for setting the ignition monitor signal at a timing of starting energization of the ignition coil, first reset means for resetting the ignition monitor signal when the primary current of the ignition coil has exceeded a first reference level and has reached a second reference level higher than the first reference level, second reset means for resetting the ignition monitor signal when the primary current of the ignition coil is interrupted before the primary current reaches the second reference level after the primary current has exceeded the first reference level, and maintenance means for maintaining a preceding state without resetting the ignition monitor signal when the primary current does not reach the first reference level.

2. An ignition system for internal combustion engines according to claim 1, wherein the ignition monitor signal is inputted to said electronic control unit, and said electronic control unit computes an optimum energization time in such a manner that a time difference between the ignition timing of the ignition signal and the reset timing of the ignition monitor signal has a predetermined time length, thereby determining a pulse width of the ignition signal which defines the energization time before the primary current of the ignition coil reaches the second reference level.

3. An ignition system for internal combustion engines according to claim 1, wherein the ignition monitor signal is inputted to said electronic control unit, and said electronic control unit monitors the ignition monitor signal, and decides that the ignition of the internal combustion engine is not effected normally and causes fuel supply to the internal combustion engine to be stopped upon detection of one of the cases where a pulse width of the ignition monitor signal is smaller than a predetermined magnitude, where the ignition monitor signal remains set without being reset, and where the ignition monitor signal remains reset without being set.

4. An ignition system for internal combustion engines according to claim 1, further comprising ignition monitor signal reset detection means for detecting whether the ignition monitor signal has been reset or not at every period of generation of the ignition signal, ignition monitor signal width decision means for deciding whether a pulse width of the ignition monitor signal is smaller than a predetermined value or not, counting means for counting the number of times that said ignition monitor signal reset detection means does not detect that the ignition monitor signal has been reset and the number of times that said ignition monitor signal width decision means decides that the pulse width of the ignition monitor signal is smaller than a predetermined value, and count value decision means for deciding that a fault has occurred when a count value of said counting means exceeds a predetermined value.

5. An ignition system for internal combustion engines comprising an electronic control unit for computing an ignition timing electronically in accordance with parameters of an internal combustion engine, computing an energization time of an ignition coil and producing a pulse-shaped ignition signal according to a result of the computation, and ignition circuit means for interrupting a primary current of the ignition coil on the basis of the ignition signal supplied from said electronic control unit and producing an ignition monitor signal, wherein said ignition circuit means includes set means for setting the ignition monitor signal at a timing of starting energization of the ignition coil, first reset means for resetting the ignition monitor signal when the primary current of the ignition coil has exceeded a first reference level and has reached a second reference level higher than the first reference level, current limiting means for limiting the primary current of the ignition coil to a predetermined value when the primary current reaches a third reference level still higher than the second reference level, the predetermined value being determined in accordance with the third reference level, second reset means for resetting the ignition monitor signal when the primary current of the ignition coil is interrupted before the primary current reaches the second reference level after the primary current has exceeded the first reference level, and maintenance means for maintaining a preceding state without resetting the ignition monitor signal when the primary current does not reach the first reference level.

6. An ignition system for internal combustion engines according to claim 5, wherein the ignition monitor signal is inputted to said electronic control unit, and said electronic control unit computes an optimum energization time in such a manner that a time difference between the ignition timing of the ignition signal and the reset timing of the ignition monitor signal has a predetermined time length, thereby determining a pulse width of the ignition signal which defines the energization time before the primary current of the ignition coil reaches the second reference level.

7. An ignition system for internal combustion engines according to claim 5, wherein the ignition monitor signal is inputted to said electronic control unit, and said electronic control unit monitors the ignition monitor signal, and decides that the ignition of the internal combustion engine is not effected normally and causes fuel supply to the internal combustion engine to be stopped upon detection of one of the cases where a pulse width of the ignition monitor signal is smaller than a predetermined magnitude, where the ignition monitor signal remains set without being reset, and where the ignition monitor signal remains reset without being set.

8. An ignition system for internal combustion engines, comprising an electronic control unit for computing an ignition timing electronically in accordance with parameters of an internal combustion engine, computing an energization time of an ignition coil and producing a pulse-shaped ignition signal according to a result of the computation, and ignition circuit means for interrupting a primary current of the ignition coil on the basis of the ignition signal supplied from said electronic control unit and producing an ignition monitor signal, wherein said ignition circuit means includes set means for setting the ignition monitor signal at a timing of starting energization of the ignition coil, first reset means for resetting the ignition monitor signal when the primary current of the ignition coil has exceeded a first reference level and has reached a second reference level higher than the first reference level, second reset means for resetting the ignition monitor signal when the primary current of the ignition coil is interrupted before the primary current reaches the second reference level after the primary current has exceeded the first reference level, maintenance means for maintaining a preceding state without resetting the ignition monitor signal when the primary current does not reach the first reference level, and a monostable circuit triggered at the reset timing of the ignition monitor signal for generating a monostable signal of a predetermined time width.

9. An ignition system for internal combustion engines according to claim 8, wherein the monostable signal is inputted to said electronic control unit, and said electronic control unit computes an optimum energization time in such a manner that a time difference between the ignition timing of the ignition signal and a timing of generation of the monostable signal has a predetermined time length, thereby determining a pulse width of the ignition signal which defines the energization time before the primary current of the ignition coil reaches the second reference level.

10. An ignition system for internal combustion engines according to claim 8, wherein the monostable signal is inputted to said electronic control unit, and said electronic control unit monitors the monostable signal, and decides that the ignition of the internal combustion engine is not effected normally and causes fuel supply to the internal combustion engine to be stopped upon detection of one of the cases where a time width from the timing of starting energization of the ignition coil to the timing of generation of the monostable signal is shorter than a predetermined time length, and where the monostable signal is not generated in spite that the ignition signal has been generated.

11. An ignition system for internal combustion engines according to claim 8, wherein said internal combustion engine is provided with a plurality of ignition coils whose number corresponds to that of engine cylinders, and the stoppage of fuel supply is effected only in an engine cylinder for which said electronic control unit has decided that the ignition is not effected normally.

12. An ignition system for internal combustion engines comprising ignition signal generating means for generating an ignition signal in response to the revolution of an internal combustion engine and ignition circuit means for interrupting a primary current of an ignition coil in accordance with the ignition signal supplied from said ignition signal generating means, wherein said ignition circuit means includes an ignition monitor signal producing circuit for producing an ignition monitor signal, which ignition monitor signal producing circuit operates to set the ignition monitor signal at a timing of starting energization of the ignition coil and to reset the ignition monitor signal at one of the timings when the primary current of the ignition coil reaches a predetermined reference level and when the primary curent is interrupted, whichever occurs earlier, and said ignition circuit means further includes fault decision means for deciding that a fault has occurred on the side of the ignition coil upon detecting that a pulse width of the ignition monitor signal is smaller than a predetermined value.

13. An ignition system for internal combustion engines according to claim 12, wherein said fault decision means includes ignition monitor signal width decision means for deciding whether the pulse width of the ignition monitor signal is smaller than a predetermined value, counting means for counting the number of times that said ignition monitor signal width decision means decides that the pulse width of the ignition monitor signal is smaller than the predetermined value, and count value decision means for deciding that a fault has occurred when a count value of said counting means exceeds a predetermined value.

14. In an ignition system for internal combustion engines comprising ignition signal generating means for generating an ignition signal in response to the revolution of an internal combustion engine and ignition circuit means for interrupting a primary current of an ignition coil in accordance with the ignition signal supplied from said ignition signal generating means, wherein said ignition circuit means includes an ignition monitor signal producing circuit for producing an ignition monitor signal, which ignition monitor signal producing circuit operates to set the ignition monitor signal at a timing of starting energization of the ignition coil and to reset the ignition monitor signal at one of the timings when the primary current of the ignition coil reaches a predetermined reference level and when the primary current is interrupted, whichever occurs earlier, a method of deciding whether the operation of said ignition circuit means is normal or faulty, comprising the steps of:

setting an ignition timer to an ignition timing, which takes precedence over a primary current conduction period limiting timing, in response to a signal representing a reference rotational position of said internal combustion engine;

resetting the ignition signal and setting an energization timer to a timing of starting conduction of the primary current of the ignition coil, simultaneously with the generation of a signal by the ignition timer indicating that the ignition timing has been reached;

starting conduction of the primary current of the ignition coil in response to the generation of a signal by the energization timer indicating that the primary current conduction start timing has been reached, and, at the same time, setting the ignition signal, setting the ignition timer to the primary current conduction period limiting timing, setting the ignition monitor signal, and storing the set time of the ignition monitor signal;

detecting and storing the reset time of the ignition monitor signal;

producing ignition spark and storing the ignition timing in response to the generation of a signal by the ignition timer indicating that the ignition timing has been reached;

computing a time width of the ignition monitor signal from a time difference between the set time and reset time of the ignition monitor signal, comparing a computed value of the time width of the ignition monitor signal with a predetermined value, and deciding that the operation of said ignition circuit means is normal when the computed time width value is greater than the predetermined value, while, that the operation of said ignition circuit means is faulty in one of the case when the computed time width value is smaller than the predetermined value and when the reset of the ignition monitor signal is not detected;

computing a time difference t1 between the ignition timing and the reset time of the ignition monitor signal;

computing a next primary current conduction period of the ignition coil by using the computed value of t1 so that the value of t1 may become equal to a predetermined value;

adjusting the next primary current conduction period of the ignition coil to fall between a preset maximum value and a preset minimum value;

setting the energization timer to a next primary current conduction start timing of the ignition coil; and counting the number of times of occurrence of faulty ignition states and setting the primary current conduction period of the ignition coil at a preset basic conduction time period when it is decided that the count value is greater than a predetermined value.

* * * * *